US010099851B2

(12) United States Patent
Bilger

(10) Patent No.: US 10,099,851 B2
(45) Date of Patent: Oct. 16, 2018

(54) SELF-RETRACTING, INSULATED DRY ICE CONTAINER AND GAS DISPENSER FOR ENHANCED SHIPPING CONTAINER REFRIGERATION

(71) Applicant: Air Liquide Industrial U.S. LP, Houston, TX (US)

(72) Inventor: Stephen Bilger, Houston, TX (US)

(73) Assignee: Airgas USA, LLC, Radnor, PA (US)

( * ) Notice: Subject to any disclaimer, the term of this patent is extended or adjusted under 35 U.S.C. 154(b) by 210 days.

(21) Appl. No.: 14/942,356

(22) Filed: Nov. 16, 2015

(65) Prior Publication Data

US 2017/0137214 A1 May 18, 2017

(51) Int. Cl.

| | |
|---|---|
| ***F25D 3/12*** | (2006.01) |
| ***B65D 88/74*** | (2006.01) |
| ***B65D 90/02*** | (2006.01) |

(52) U.S. Cl.

CPC ..... *B65D 88/745* (2013.01); *B65D 90/02* (2013.01); *F25D 3/125* (2013.01)

(58) Field of Classification Search

CPC ..... F25D 3/12; F25D 3/125

See application file for complete search history.

(56) References Cited

U.S. PATENT DOCUMENTS

| | | | | |
|---|---|---|---|---|
| 1,951,679 | A | 3/1934 | Sherrick | |
| 2,032,130 | A | 2/1936 | Jurkat et al. | |
| 5,271,233 | A | 12/1993 | Parker et al. | |
| 6,381,981 | B1 * | 5/2002 | Yaddgo | F25D 3/125 62/372 |

FOREIGN PATENT DOCUMENTS

| | | |
|---|---|---|
| GB | 434 569 | 9/1935 |
| JP | 2002 002819 | 1/2002 |

OTHER PUBLICATIONS

International Search Report and Written Opinion for corresponding PCT/US2016/062265, dated Feb. 20, 2017.

* cited by examiner

*Primary Examiner* — Elizabeth Martin
(74) *Attorney, Agent, or Firm* — Elwood L. Haynes

(57) ABSTRACT

A self-retracting dry ice container enclosing solid carbon dioxide and retracting as the solid carbon dioxide sublimates is provided

3 Claims, 12 Drawing Sheets

A

B

C

SELF-RETRACTING, INSULATED DRY ICE CONTAINER AND GAS DISPENSER FOR ENHANCED SHIPPING CONTAINER REFRIGERATION

BACKGROUND

A wide variety of perishable items particularly such as food products are routinely shipped in a chilled or frozen state to avoid product spoilage and/or contamination. In this regard, refrigeration systems for use in transport or shipping vehicles such as rail cars, trucks, and the like are well known and have been widely used for many years. In one common form, such refrigeration systems have utilized conventional mechanical refrigeration units for maintaining a controlled temperature within an insulated storage container or compartment. However, mechanical refrigeration units are relatively costly and require significant maintenance over a typical service life. Moreover, mechanical refrigeration equipment normally exhibits relatively high power or energy consumption, wherein an appropriate fuel or electrical power source for the refrigeration unit must be carried with the shipping vehicle.

In recent years, non-mechanical refrigeration systems have acquired significant commercial interest in efforts to avoid the cost and related complexities associated with standard mechanical refrigeration equipment. In a non-mechanical system, the rail car or the like is modified to carry an expendable supply of a cryogenic material, particularly such as carbon dioxide in solid form, commonly known as dry ice. The cryogenic material is supported in close association with the items being shipped to maintain a sufficiently low temperature to prevent spoilage. Over a period of time which may include several days, the solid carbon dioxide sublimates into the form of cryogenic gas which is normally circulated over or about the perishable items prior to exhausting to the atmosphere through suitable vents.

The traditional method to transport frozen food in shipping containers is to manually layer the food items with slices of dry ice in a cardboard or insulated box on a pallet. This is labor-intensive and inefficient because the food is in direct contact with the $CO_2$ ice or snow, causing the food to freeze below the required temperature and the $CO_2$ to sublime faster. This is an inefficient use of $CO_2$ because the food is in direct contact and causes it to sublime faster, thus reducing the time the shipping container will be refrigerated.

SUMMARY

In one embodiment of the present invention, a self-retracting dry ice container, comprising a means for enclosing solid carbon dioxide is provided. The means are adapted to retract as the solid carbon dioxide sublimates. The container may include a receptacle configured to accept a carbon dioxide fill lance thereby allowing the admission of carbon dioxide into the means for enclosing solid carbon dioxide. The container may include a shipping container with a refrigerated storage compartment and a ceiling, wherein said shipping container is adapted to allow the self-retracting dry ice container to mount a position proximate to the ceiling. The means for enclosing solid carbon dioxide may include a carbon dioxide vapor flow distribution means for allowing the sublimated carbon dioxide to enter the refrigerated storage compartment of the shipping container. The carbon dioxide vapor flow distribution means may include a control means.

In another embodiment of the present invention, a self-retracting dry ice container for a shipping container is provided. The shipping container has side walls, a back wall, a ceiling, and a storage compartment. In one embodiment of the present invention, multiple retracting sections are employed. In such a configuration, the dry ice container has a panel of generally rectangular shape and having a width sufficient to span between the side walls defining the storage compartment. The panel includes one or more sections of equal or different volumes each adapted to receive solid carbon dioxide. These front and rear panels are used to help contain the solid carbon dioxide snow as it is injected in the bunker. In another embodiment, if a single section is used, the front and rear panel may not be needed, as the single section will span the width between the side walls of the shipping container. The panel includes a means for mounting the panel in a position proximate to the ceiling. The sections are adapted to retract toward the ceiling as the solid carbon dioxide sublimates.

The self-retracting dry ice container may include a receptacle configured to accept a removable carbon dioxide fill lance or built-in manifold thereby allowing the admission of carbon dioxide into the one or more sections. The sections or panel may include a carbon dioxide vapor flow distributor for allowing the sublimated carbon dioxide to enter the refrigerated storage compartment of the shipping container. The carbon dioxide vapor flow distributor may be adapted to allow the control of the sublimated carbon dioxide entering the refrigerated storage compartment of the shipping container.

In another embodiment of the present invention, a method for refrigerating a storage compartment is provided. The method includes providing, within a storage compartment, a self-retracting dry ice container, comprising a means for enclosing solid carbon dioxide, wherein the means are adapted to retract as the solid carbon dioxide sublimates, providing solid carbon dioxide into the self-retracting dry ice container, introducing sub-ambient temperature carbon dioxide gas to the storage compartment as the solid carbon dioxide sublimates.

In another embodiment of the present invention, a method for refrigerating a shipping container is provided. This method includes providing a shipping container having side walls, a back wall, a ceiling, and a storage compartment, providing a panel of generally rectangular shape and having a width sufficient to span between the side walls defining the storage compartment, the panel comprising one or more sections of equal or different volumes each adapted to receive solid carbon dioxide, providing a means for mounting the panel in a position proximate to the ceiling, providing solid carbon dioxide into the panel, providing refrigeration to the storage compartment by introducing sub-ambient temperature carbon dioxide gas to the storage compartment from the panel as the solid carbon dioxide sublimates, thereby allowing the sections to independently retract toward the ceiling as the solid carbon dioxide sublimates, thereby providing an indication of the quantity of remaining solid carbon dioxide and facilitating the emptying of the storage compartment.

DESCRIPTION OF PREFERRED EMBODIMENTS

Figure 1:
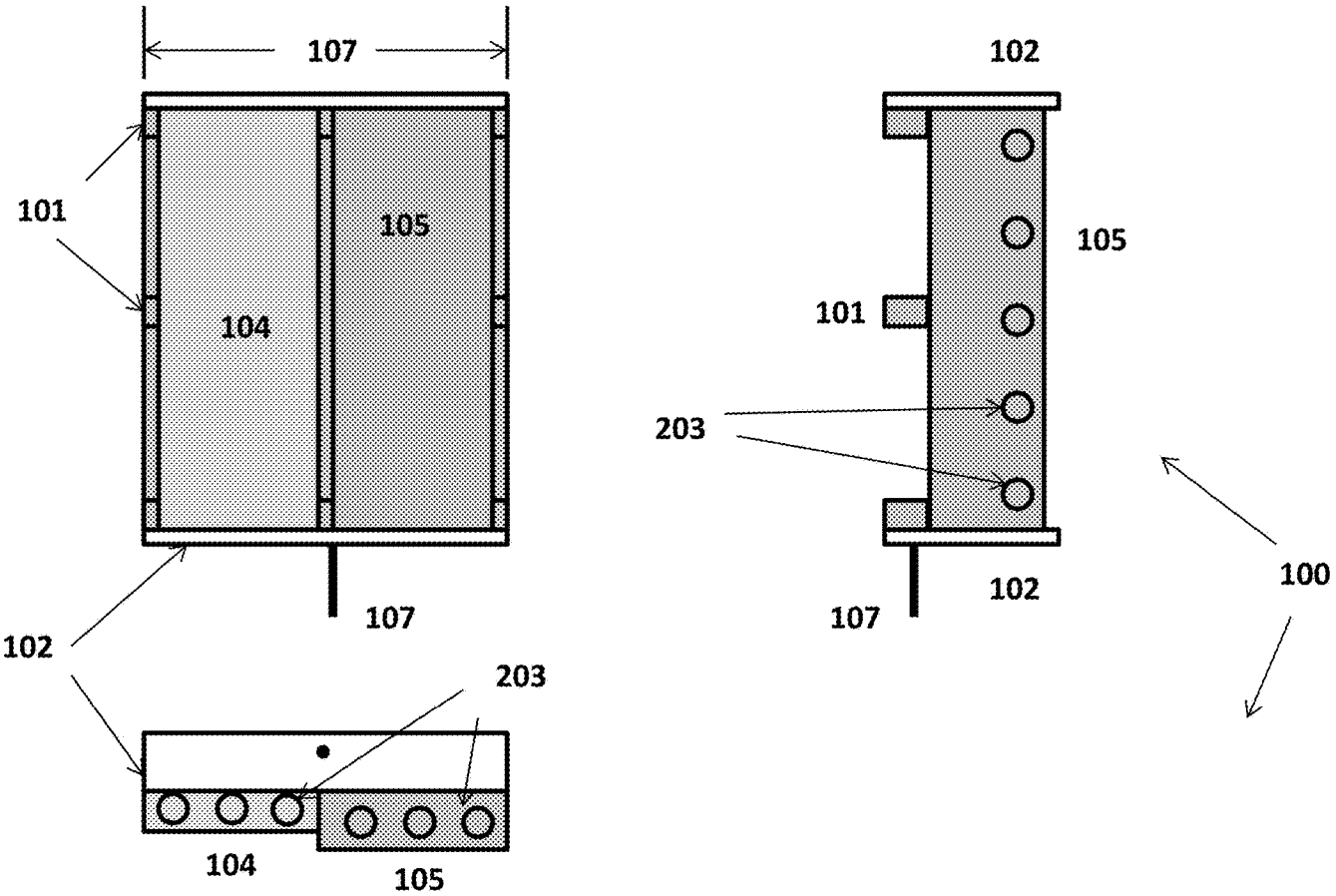
FIG. 1 illustrates schematic projection and isometric views of the self-retracting dry ice container with two retracting sections in accordance with one embodiment of the present invention.
Figure 2:
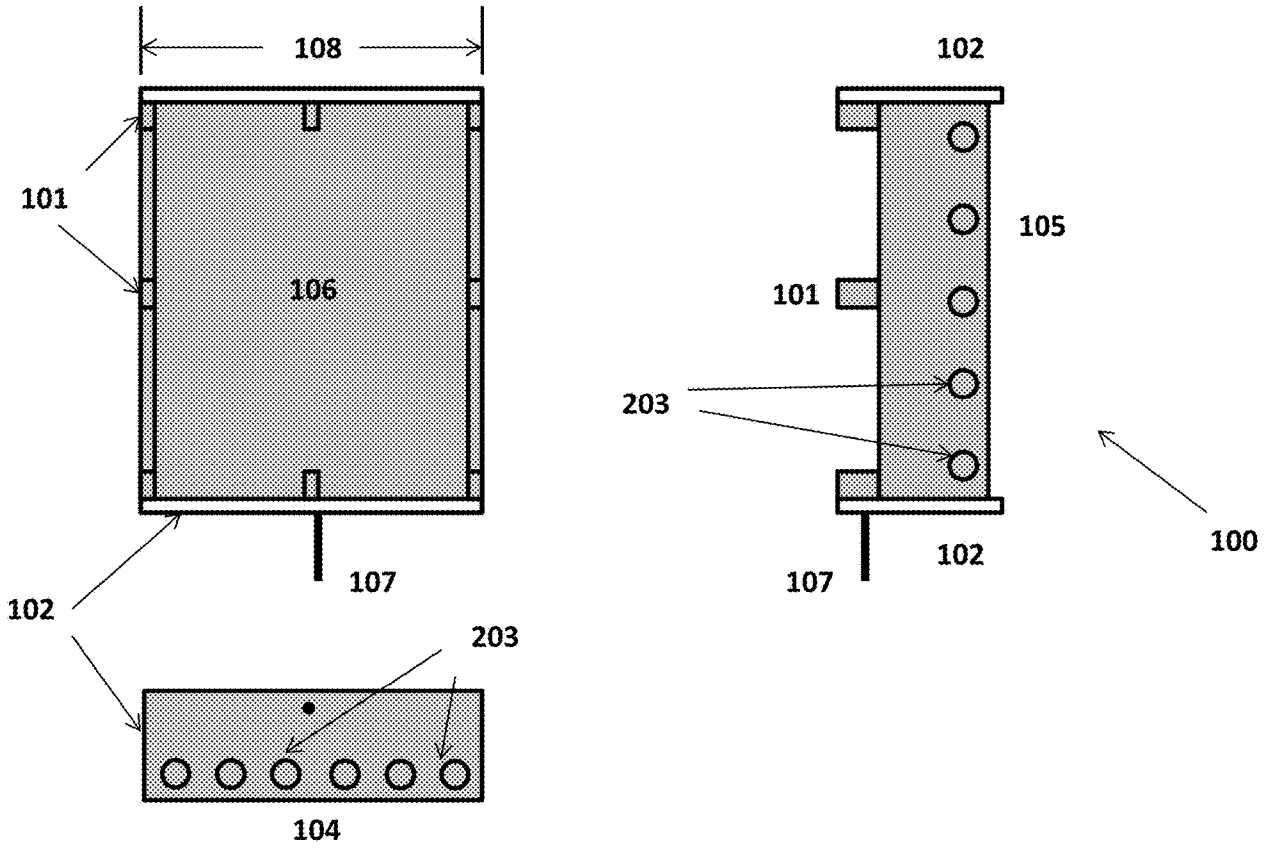
FIG. 2 illustrates schematic projection and isometric views of the self-retracting dry ice container with a single retracting section in accordance with one embodiment of the present invention.
Figure 3:
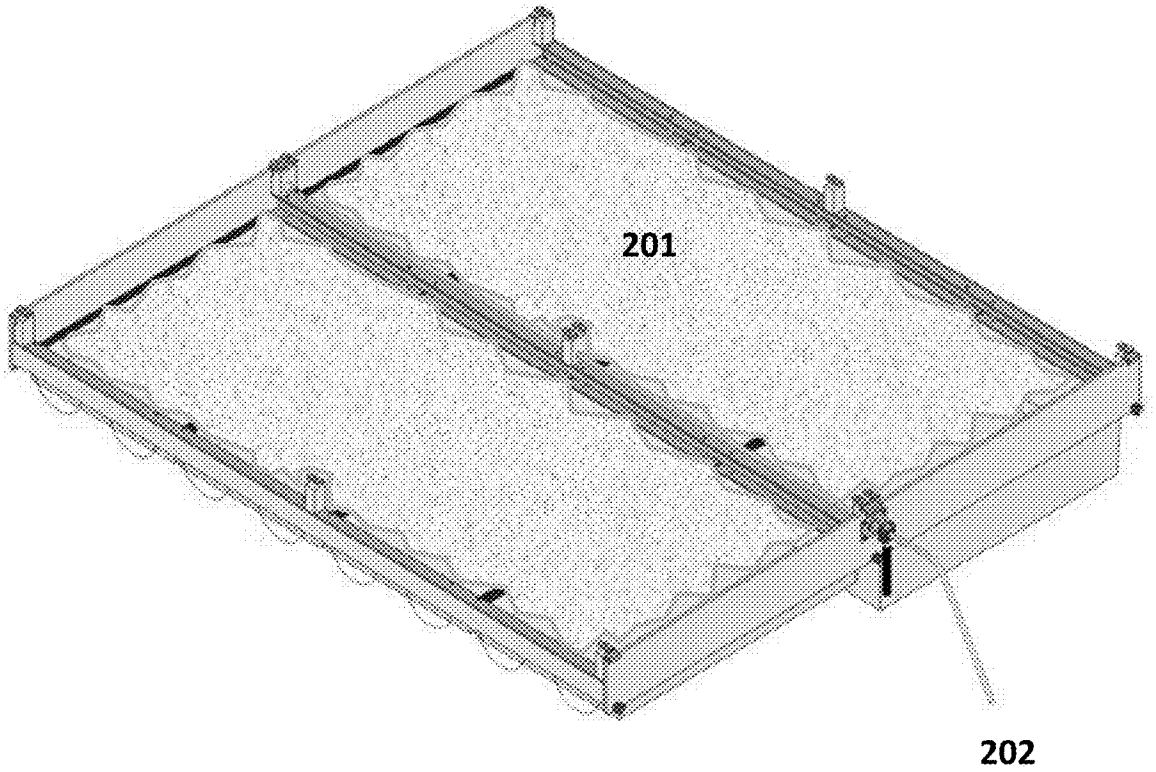
FIG. 3 illustrates an isometric view of the self-retracting dry ice container with dry ice snow in the sections in accordance with one embodiment of the present invention.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure elements:

100=self-retracting dry ice container
101=self-retracting dry ice container mount
102=dry ice container end (front and rear) panels
104=first retracting section (small volume)
105=second retracting section (large volume)
106=single retracting section
107=carbon dioxide fill lance
108=overall panel width
201=solid carbon dioxide
202=liquid carbon dioxide entering the fill lance
203=carbon dioxide vapor flow distributor
204=vapor flow distributor flow control
301=first mounting bracket (for shipping container wall)
302=second mounting bracket (for self-retracting dry ice container)
303=retraction spring
501=shipping container
502=shipping container side walls
503=shipping container ceiling
504=shipping container back wall
505=shipping container front doors
506=refrigerated storage compartment within shipping container
507=first refrigerated cargo element within shipping container
508=second refrigerated cargo element within shipping container
509=single refrigerated cargo element within shipping container With reference to FIGS. 1-12, a self-retracting dry ice container (100) is presented. This self-retracting dry ice container (100) includes a means for containing solid carbon dioxide (104, 105), wherein the means are adapted to retract (FIG. 5*a*, FIG. 5*b*, and FIG. 5*c*) as the solid carbon dioxide sublimates.

The self-retracting dry ice container (100) is adapted to fit in a shipping container (501). The shipping container (501) has side walls (502), a back wall (504), a ceiling (503), and a storage compartment (506). The shipping container may contain one or more cargo elements (507, 508, 509). The first retracting section (104) (if more than one are present) may be adapted to fit a first refrigerated cargo element within the shipping container (507). A second retracting section (105) may be conformed to fit a second refrigerated cargo element within the shipping container (508). The shipping container (501) may be of any type known to the art, such as a standard intermodal freight container. But the present invention is of particular interest to insulated shipping or insulated intermodal containers, used in a cold product chain. The cargo elements (507, 508, 509) may be of any type commonly transported in these containers, such as palletized goods or a Bonar PB55 insulated container.

The self-retracting dry ice container (100) has generally rectangular shape and having a width (107) sufficient to span between the side walls (502) defining the storage compartment (506). The self-retracting dry ice container (100) may be made up of one or more sections (104, 105, 106) each adapted to receive solid carbon dioxide (201). The self-retracting dry ice container (100) includes a self-retracting dry ice container mount (101) for mounting the panel in a position proximate to the ceiling (503), wherein the sections (104, 105) are adapted to retract (FIG. 5*a*, FIG. 5*b*, and FIG. 5*c*) toward the ceiling (503) as the solid carbon dioxide sublimates.

The self-retracting dry ice container may also include a receptacle configured to receive a carbon dioxide fill lance thus allowing the admission of carbon dioxide into the means for containing solid carbon dioxide, or the one or more sections. The lance itself is typically a part of the carbon dioxide refill station, and is removed from the self retracting dry ice container after filling is complete. In another embodiment, not shown, a permanent carbon dioxide manifold is part of the self retracting dry ice container. A quick disconnect type attachment would allow connection with a carbon dioxide supply.

The section or sections (104, 105) which are adapted to receive solid carbon dioxide (201) may have a top section to enclose the solid dry ice (not shown), or it may use the shipping container ceiling (503) to contain the solid dry ice. If the shipping container ceiling (503) is used to contain the solid dry ice, the resulting volume available for the dry ice is greater, and hence more dry ice and enhanced cooling capacity is available. The carbon dioxide snow will not tend to spill out as the self-retracting dry ice container itself spans the full perimeter of the shipping container (501), from the front walls (505) to the back walls (504), and between the side walls (502).

Figure 4:
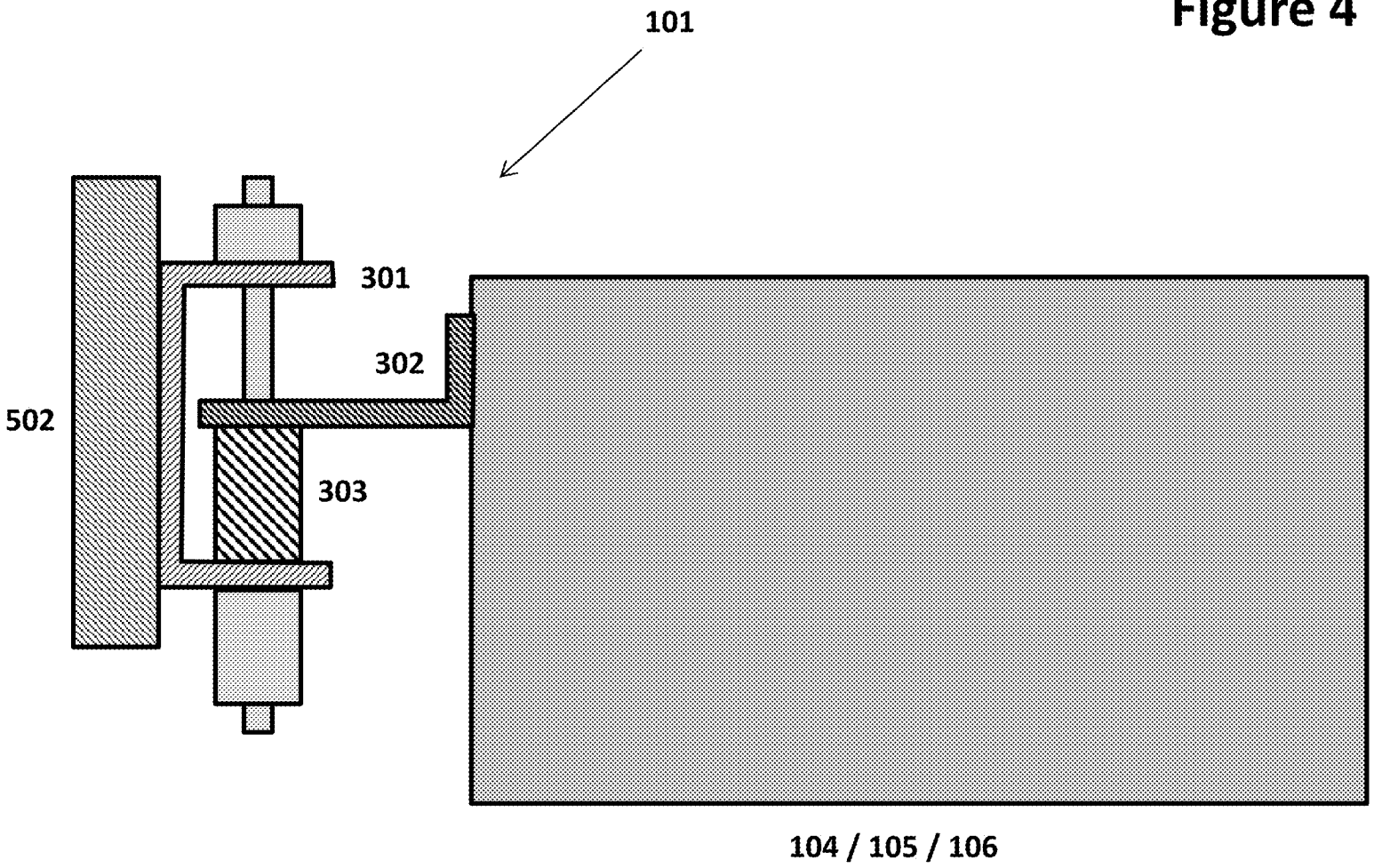
FIG. 4 illustrates operational details of the retracting mounting mechanism for the self-retracting dry ice container in accordance with one embodiment of the present invention.

The self-retracting dry ice container mount (101) is illustrated in FIG. 4. This illustrates only one embodiment, and one skilled in the art would recognize that additional mounting means are possible. The self-retracting dry ice container mount (101), at its most basic, consists of three components; a first mounting bracket for the shipping container wall (301), a second mounting bracket for the self-retracting dry ice container (302), and a retraction spring (303).

Figures 5A, 5B, 5C:
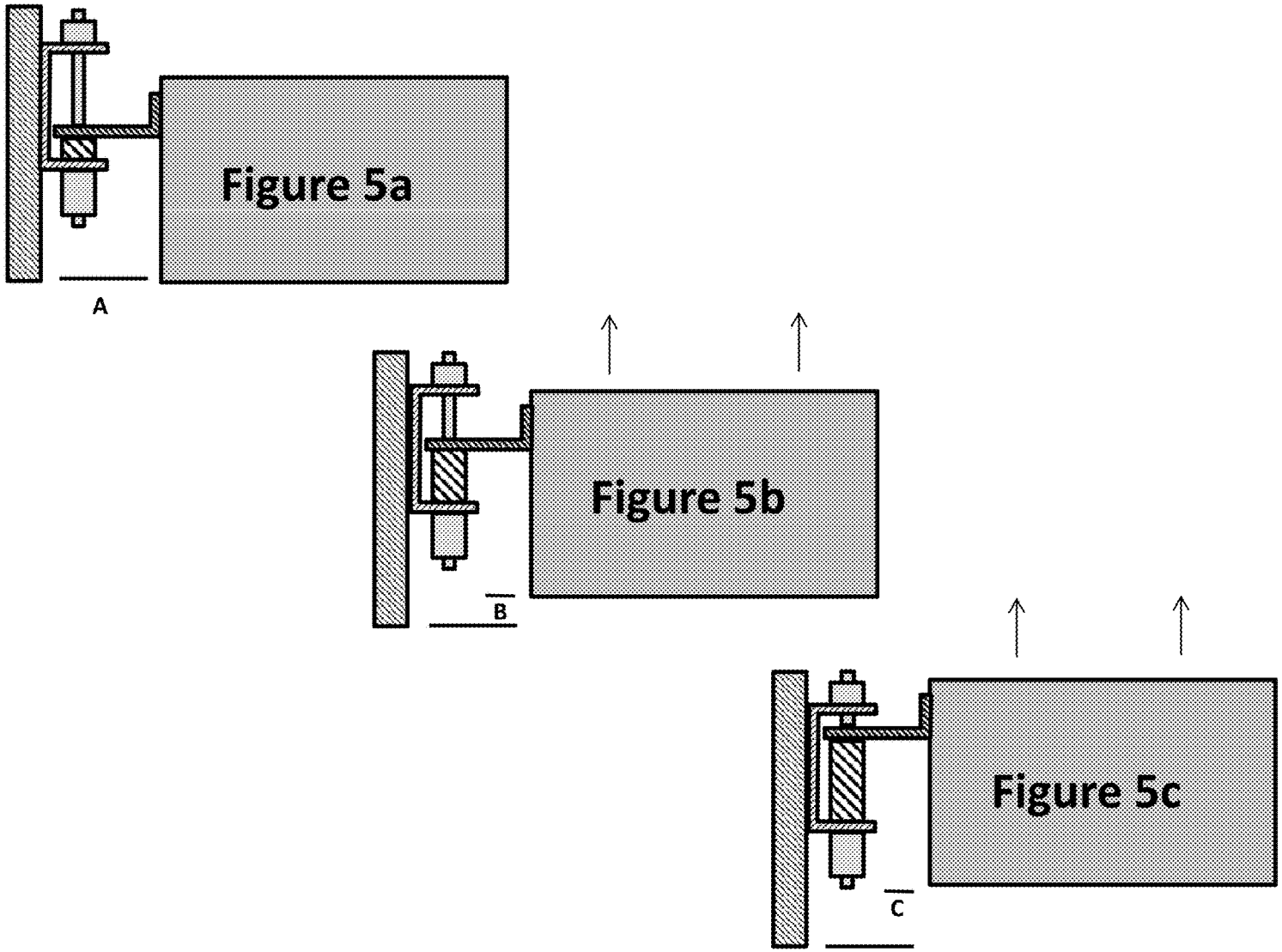
FIGS. 5*a* to 5*c* illustrate the retraction of the self-retracing dry ice container in accordance with one embodiment of the present invention.
Figure 6:
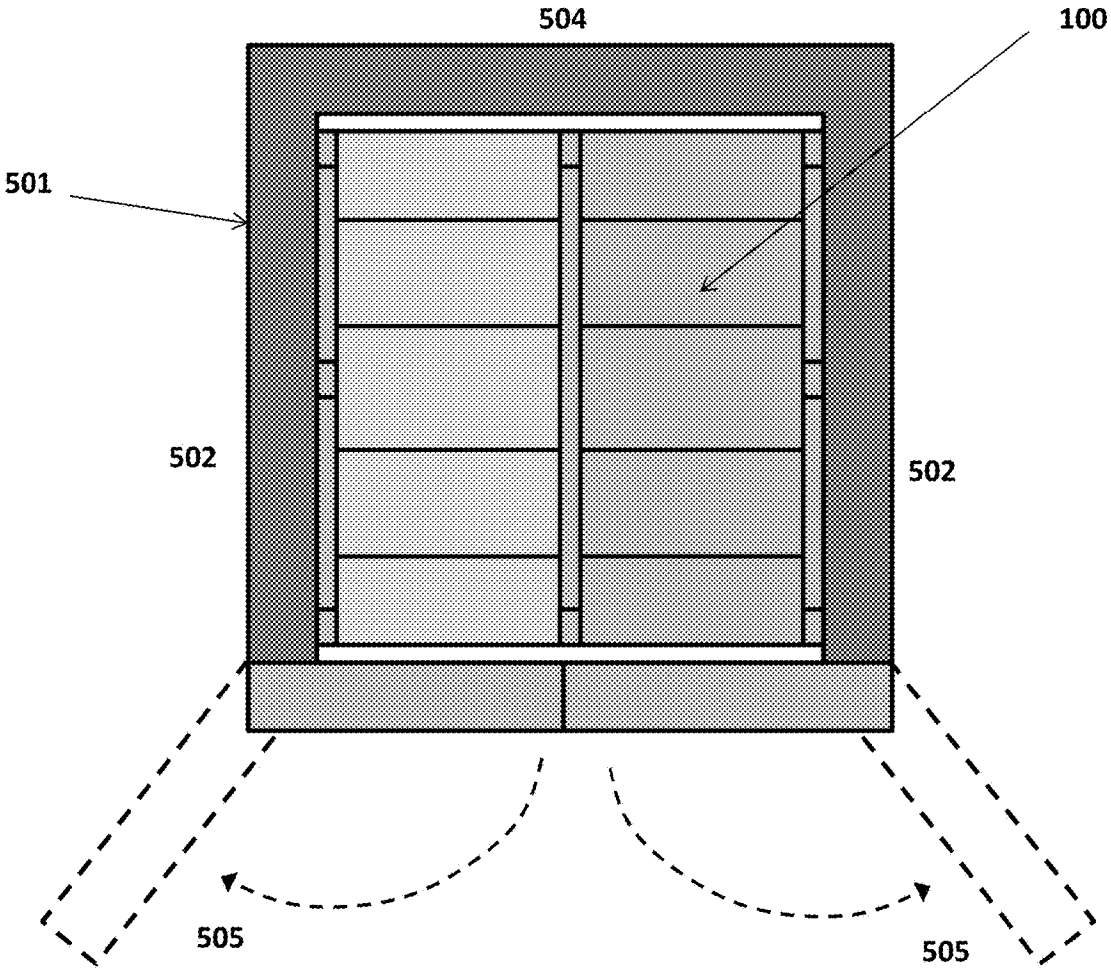
FIG. 6 illustrates a plan view of a shipping container with the self-retracting dry ice container having two retracting sections, in particular illustrating the container doors, in accordance with one embodiment of the present invention.
Figure 7:
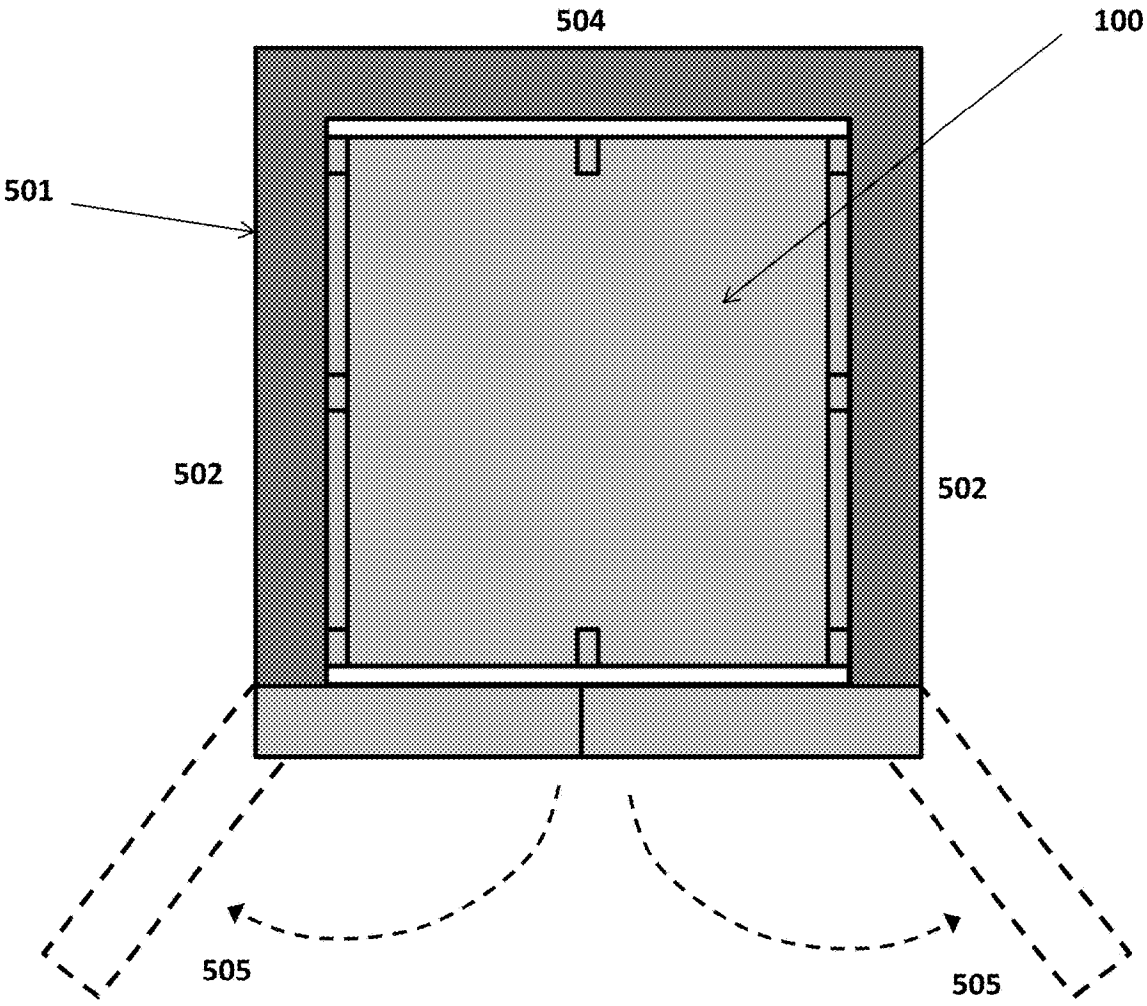
FIG. 7 illustrates a plan view of a shipping container with the self-retracting dry ice container having a single retracting section, in particular illustrating the container doors, in accordance with one embodiment of the present invention.
Figure 8:
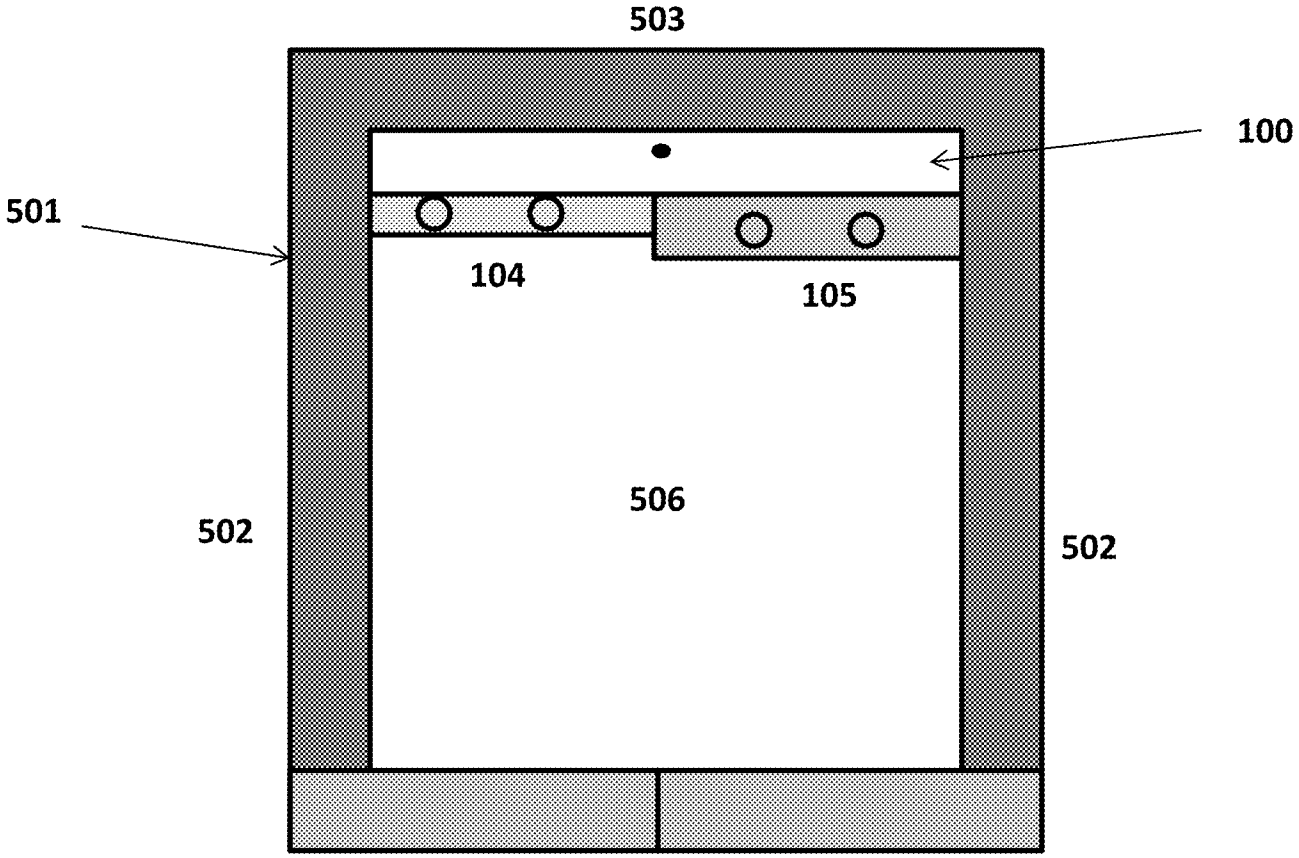
FIG. 8 illustrates a front elevation view of a shipping container with the self-retracting dry ice container having two retracting sections, with the container doors removed for clarity, in accordance with one embodiment of the present invention.
Figure 9:
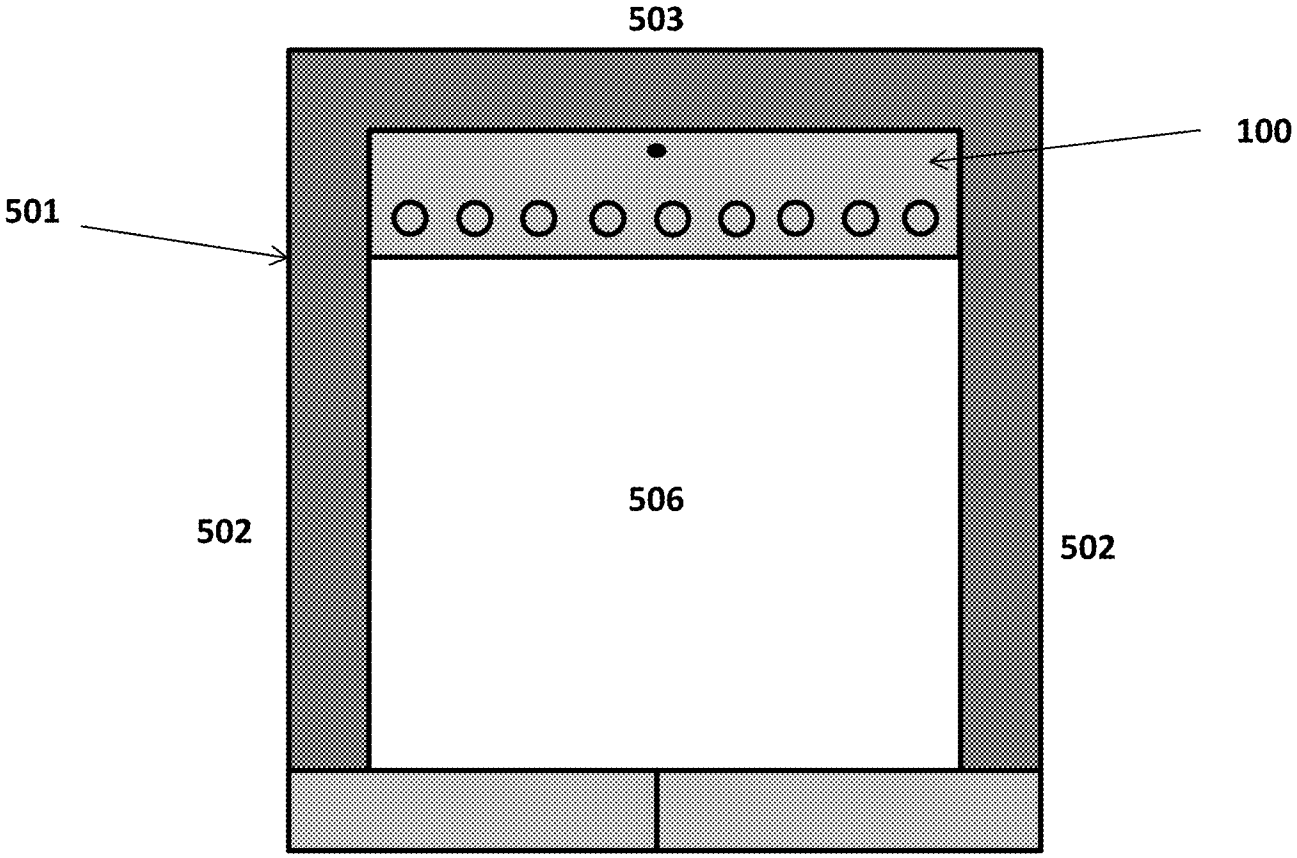
FIG. 9 illustrates a front elevation view of a shipping container with the self-retracting dry ice container having a single retracting section, with the container doors removed for clarity, in accordance with one embodiment of the present invention.
Figure 10:
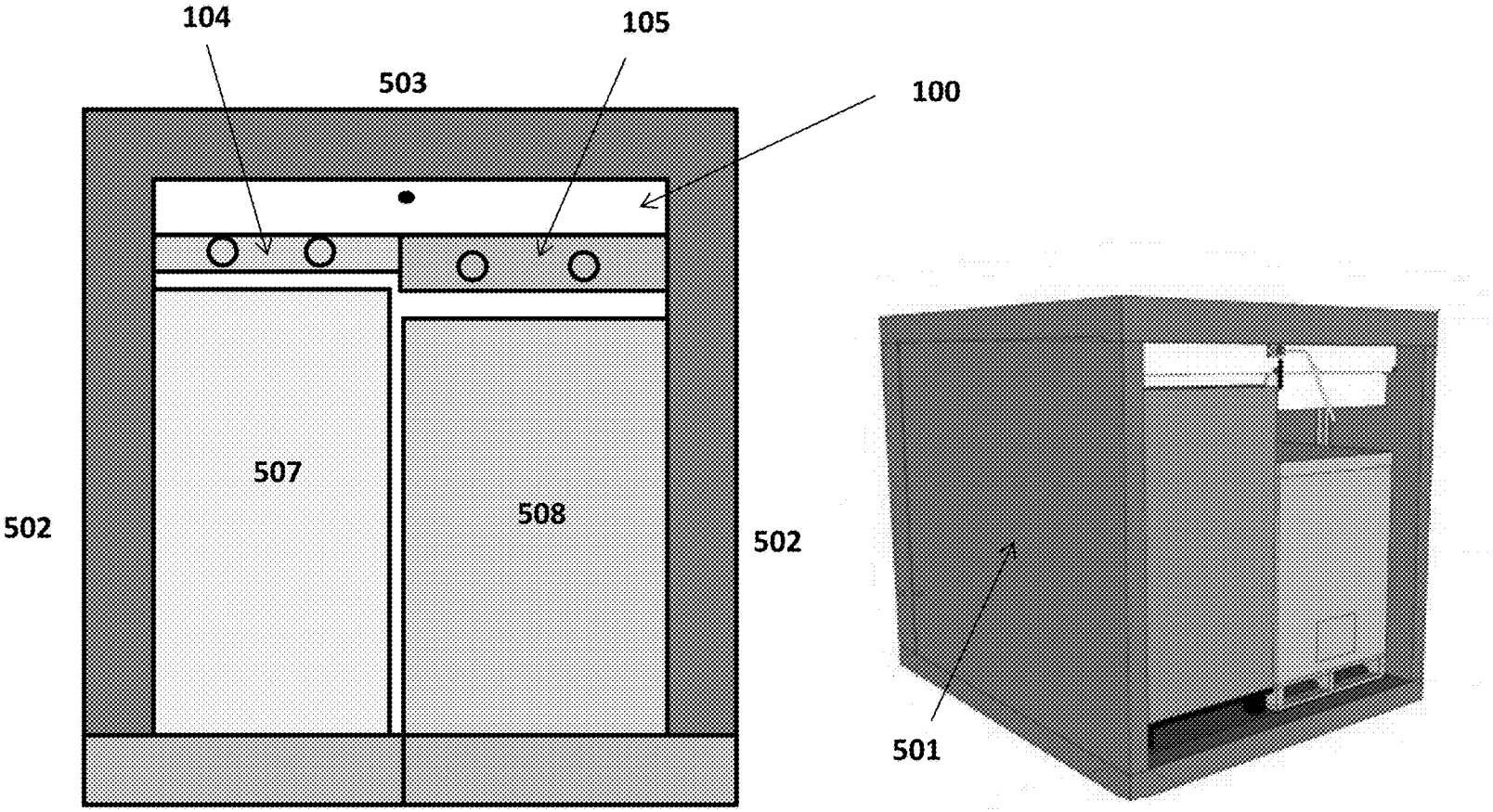
FIG. 10 illustrates a front elevation view of a shipping container with the self-retracting dry ice container having two retracting sections, with cargo within the storage container, in accordance with one embodiment of the present invention.
Figure 11:
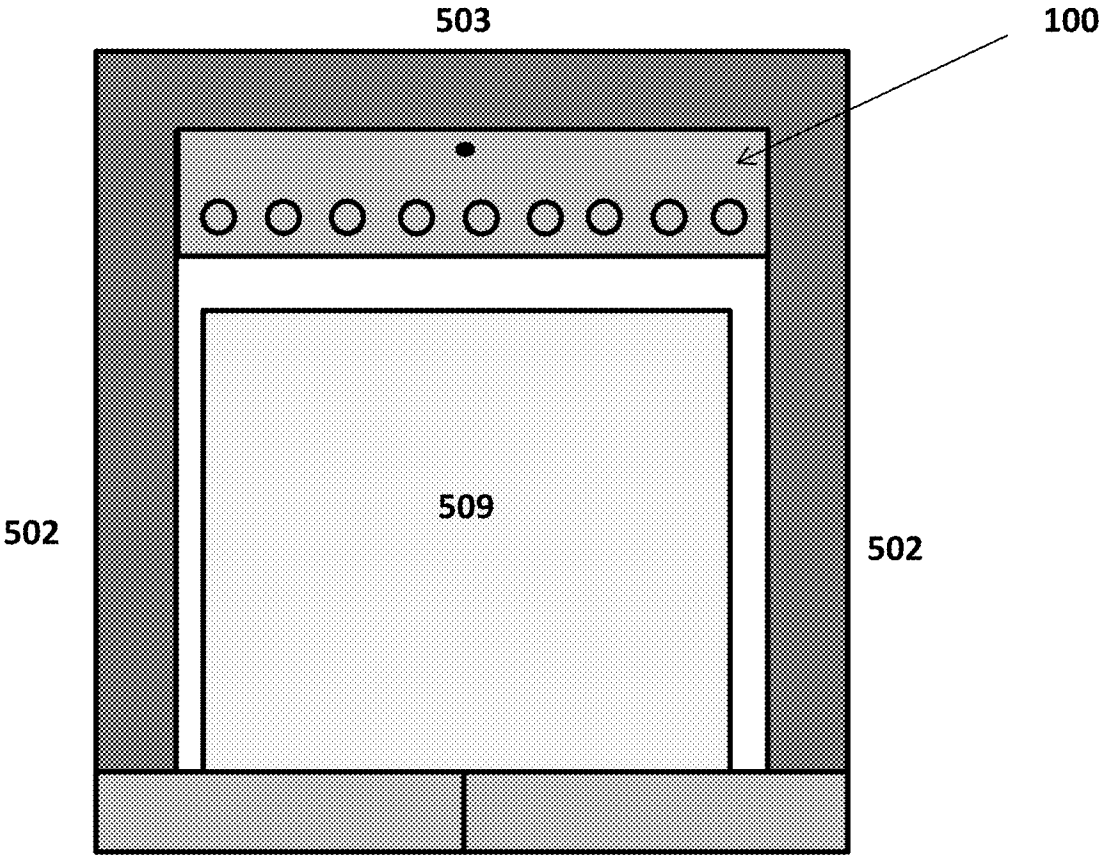
FIG. 11 illustrates a front elevation view of a shipping container with the self-retracting dry ice container having a single retracting section, with cargo within the storage container, in accordance with one embodiment of the present invention.
Figure 12:
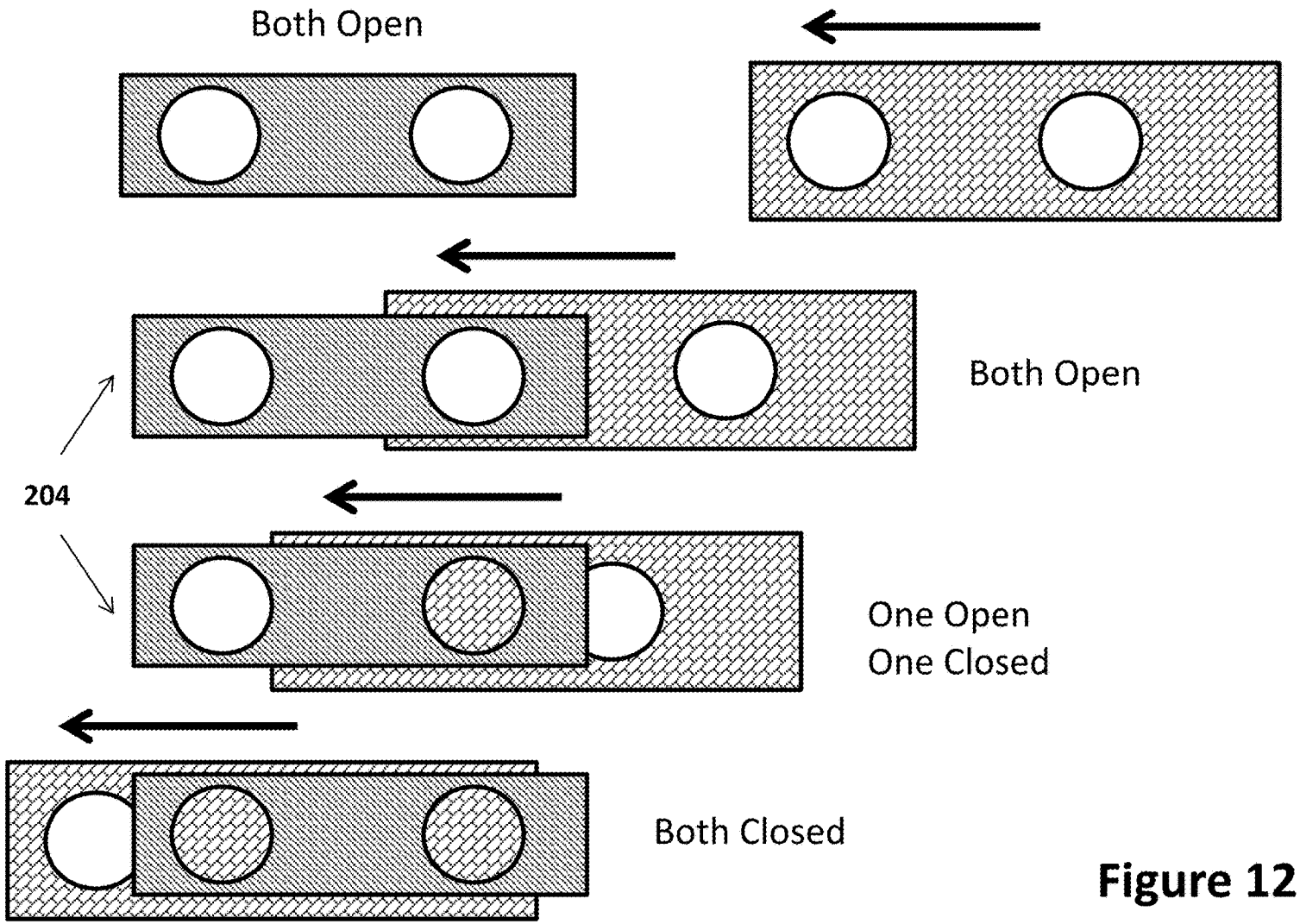
FIG. 12 is a symbolic representation of a sliding valve vapor flow distributor flow control device, in accordance with one embodiment of the present invention.

As illustrated in FIGS. 5*a*-5*c*, as the self-retracting dry ice container is filled with solid carbon dioxide it becomes heavier. This causes the spring to compress and the self-retracting dry ice container to lower, resulting in the full self retracting dry ice container having an initial location of A. This situates the self-retracting dry ice container at the lowest position within the storage container. As the solid carbon dioxide sublimates, and the resulting gas refrigerates the shipping container, the self-retracting dry ice container rises, as the spring forces it upwards, to location B. As the last of the solid carbon dioxide sublimates, the self-retracting dry ice container becomes situated at the highest position within the container, at location C. This allows a visual inspection to reveal the amount of solid carbon dioxide remaining, as well as addition additional clearance within the storage container to facilitate cargo handling. As each section may have its own, dedicated mounts, each section may act independently, rising or settling as that particular amount of dry ice varies.

The self-retracting dry ice container also includes a carbon dioxide vapor flow distribution means (203) or flow distributor (203) for allowing the sublimated carbon dioxide to enter the refrigerated storage compartment (506) of the shipping container (501). The distribution means (203) or flow distributor (203) are located on one or more of the front or rear portions of the front and rear of the retracting section (or if present the front or rear panels), or either of the side sides of the retracting section. The carbon dioxide vapor flow distribution (203) means or flow distributor (203) further comprises a control means (204).

In another embodiment of the present invention, a method for refrigerating a storage compartment (506) within a shipping container (501) is provided. This method includes, providing, within a storage compartment (506), a self-retracting dry ice container (100), comprising a means for enclosing solid carbon dioxide (104, 105, 106). The means are adapted to retract as the solid carbon dioxide sublimates. As the solid carbon dioxide sublimates, sub-ambient temperature carbon dioxide gas is introduced into the storage compartment (506).

In another embodiment, a method for refrigerating a shipping container is provided, that includes providing a shipping container (501) having side walls (502), a back wall (504), a ceiling (503), and a storage compartment (506). This method also includes providing a self-retracting dry ice container of generally rectangular shape and having a width (107) sufficient to span between the side walls (502) defining the storage compartment (506). The self-retracting dry ice container (100) will have one or more sections of equal or different volumes (104, 105, 106) each adapted to receive solid carbon dioxide (201). This method includes providing a means (101) for mounting the panel in a position proximate to the ceiling (503).

Solid carbon dioxide (201) is introduced into the self-retracting dry ice container (100). This may be done by introducing pressurized gaseous/liquid carbon dioxide (202) into a receptacle configured to accept a removable carbon dioxide fill lance (106) or permanent manifold (not shown), which then dispenses the gaseous/liquid carbon dioxide into the panel through one or more orifices. The orifices are sized and positioned along the lance (not shown) to dispense the proper amount of CO2 into each section. As the pressurized carbon dioxide exits the carbon dioxide fill lance (107) or manifold, adiabatic expansion will cause it to freeze into solid dry ice snow (201), which will fall into and fill the (104, 105, 106) sections.

Refrigeration is then provided to the storage compartment by introducing sub-ambient temperature carbon dioxide gas to the storage compartment (506) as the solid carbon dioxide (201) sublimates. The dry ice gas flows through a carbon dioxide vapor flow distribution means (203) or flow distributor (203) then enters the refrigerated storage compartment (506) of the shipping container (501). The flow distributor (203) may simply be a gas passageway with a series of orifices. The carbon dioxide vapor flow distribution means or flow distributor may include a control means (204). The control means may consist of manually plugging one or more holes as desired. The control means may consist of one or more valves, or sliding orifices, that can be manually adjusted to regulate the flow of gaseous carbon dioxide (as symbolically illustrated in FIG. 12).

As the solid dry ice sublimates and the gaseous carbon dioxide flows into the refrigerated storage compartment, the sections (104, 105) retract (FIG. 5*a*, FIG. 5*b*, and FIG. 5*c*) toward the ceiling (503). This retraction provides an easy, visual indication of the quantity of remaining solid carbon dioxide. As the sections retract and move out of the way, the emptying of the storage compartment is also facilitated.

What is claimed is:

1. A self-retracting dry ice container, comprising a means for containing dry ice snow, wherein the means for containing dry ice snow comprises a front panel configured to allow admission of the dry ice snow, wherein the means for containing dry ice snow is adapted to retract as the dry ice snow sublimates, wherein the means for containing dry ice snow comprises a carbon dioxide vapor flow distribution means for allowing the sublimated dry ice snow to enter a refrigerated storage compartment of the shipping container, thereby providing a cooling atmosphere within the refrigerated storage compartment, wherein the means for containing the dry ice snow lowers when full, and wherein the means for containing the dry ice snow rises as the carbon dioxide sublimates.

2. The self-retracting dry ice container of claim 1, further comprising a receptacle configured to accept a removable carbon dioxide fill lance thereby allowing the admission of carbon dioxide into the means for enclosing dry ice snow.

3. The self-retracting dry ice container of claim 1, further comprising a shipping container with a refrigerated storage compartment and a ceiling, wherein said shipping container is adapted to allow the self-retracting dry ice container to mount a position proximate to the ceiling.

* * * * *